US011421713B2

(12) United States Patent
Cullman et al.

(10) Patent No.: US 11,421,713 B2
(45) **Date of Patent: *Aug. 23, 2022**

(54) HYDRAULIC HYBRID SWING DRIVE SYSTEM FOR EXCAVATORS

(71) Applicant: Parker-Hannifin Corporation, Cleveland, OH (US)

(72) Inventors: Jeff Cullman, Wadsworth, OH (US); Hao Zhang, Twinsburg, OH (US); Richard D. Kimpel, Middleburg Hts., OH (US); Zhesheng Jiang, Solon, OH (US); Raymond Collett, Put-In-Bay, OH (US); Bogdan Kozul, Hinckley, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/925,821

(22) Filed: Mar. 20, 2018

(65) Prior Publication Data

US 2018/0209449 A1 Jul. 26, 2018

Related U.S. Application Data

(63) Continuation of application No. 14/370,795, filed as application No. PCT/US2013/020235 on Jan. 4, 2013, now Pat. No. 9,926,946.

(Continued)

(51) Int. Cl.
*F15B 1/02* (2006.01)
*E02F 9/12* (2006.01)

(Continued)

(52) U.S. Cl.
CPC ..... *F15B 1/024* (2013.01); *E02F 9/128* (2013.01); *E02F 9/202* (2013.01); *E02F 9/2217* (2013.01); *F15B 7/003* (2013.01)

(58) Field of Classification Search
CPC ..... F15B 7/003; F15B 1/024; E02F 9/202; E02F 9/128; E02F 9/2217
See application file for complete search history.

(56) References Cited

U.S. PATENT DOCUMENTS 4,778,020 A 10/1988 Hagin
8,151,563 B2 * 4/2012 Schneider ..... F15B 1/024 60/414

(Continued)

FOREIGN PATENT DOCUMENTS

CN 101321642 A 12/2008
CN 101845837 A 9/2010
DE 10 2007 012116 9/2007

OTHER PUBLICATIONS

Office Action and translation for corresponding Chinese Patent Application No. 2013800048019 dated Nov. 4, 2015.

(Continued)

*Primary Examiner* — Abiy Teka
(74) *Attorney, Agent, or Firm* — Renner, Otto, Boisselle & Sklar, LLP

(57) ABSTRACT

A swing drive system for an excavator is provided which utilizes a prime mover mechanically connected to a first hydraulic pump/motor and a second hydraulic pump/motor mechanically connected to a swing mechanism. The system includes a hydraulic circuit connecting a hydraulic fluid reservoir, a hydraulic accumulator, the first hydraulic pump/motor, and the second hydraulic pump/motor. The system is operable in one mode where the second hydraulic pump/motor acts as a pump to retard movement of the swing mechanism and pressurized hydraulic fluid from the second hydraulic pump/motor is pumped into the hydraulic accumulator. The system is operable in another mode where the pressurized fluid from the hydraulic accumulator is used to assist the prime mover in driving hydraulic consumers, including the swing drive.

12 Claims, 8 Drawing Sheets

Related U.S. Application Data

(60) Provisional application No. 61/582,862, filed on Jan. 4, 2012.

(51) Int. Cl.

| | |
|---|---|
| ***E02F 9/20*** | (2006.01) |
| ***E02F 9/22*** | (2006.01) |
| ***F15B 7/00*** | (2006.01) |

(56) References Cited

U.S. PATENT DOCUMENTS

| | | | | |
|---|---|---|---|---|
| 8,517,133 | B2 | 8/2013 | Carl | |
| 9,926,946 | B2 * | 3/2018 | Cullman | E02F 9/128 |
| 2005/0229594 | A1 | 10/2005 | Nanjo | |
| 2008/0081724 | A1 | 4/2008 | Ivantysynova | |
| 2009/0036248 | A1 | 2/2009 | Mueller | |
| 2010/0236232 | A1 | 9/2010 | Boehm et al. | |

OTHER PUBLICATIONS

International Search Report for corresponding Patent Application No. PCT/US2013/020235 dated Jul. 15, 2013.

Fan Ji et al., "Energierueckgewinnung am drehwerksantrieb eines hydrobaggers, O + P olhydraulik und pneumatik", Vereinigte fachverlage, Mainz, DE, vol. 37, No. 3, Mar. 1, 1993, pp. 190-192 and 194.

* cited by examiner

HYDRAULIC HYBRID SWING DRIVE SYSTEM FOR EXCAVATORS

CROSS REFERENCE TO RELATED APPLICATIONS

This application is a continuation of U.S. patent application Ser. No. 14/370,795 filed Jul. 7, 2014, which is a national phase of International Application No. PCT/US2013/020235 filed Jan. 4, 2013, which claims the benefit of the filing date of U.S. Provisional Patent Application Ser. No. 61/582,862, filed Jan. 4, 2012, the disclosures of which are all incorporated herein by reference in their entireties.

TECHNICAL FIELD

The present invention relates to hydraulic excavators and in particular to a hydraulic hybrid swing drive system that recovers energy during the swing brake and utilizes the recovered energy to assist the prime mover in powering the swing drive or other work functions.

BACKGROUND

An excavator is an example of construction machines that uses multiple hydraulic actuators to accomplish a variety of tasks. These actuators are fluidly connected to a pump that provides pressurized fluid to chambers within the actuators. This pressurized fluid force acting on the actuator surface causes movement of actuators and connected work tool. Once the hydraulic energy is utilized, pressurized fluid is drained from the chambers to return to a low pressure reservoir. Usually the fluid being drained is at a higher pressure than the pressure in the reservoir and hence this remaining energy is wasted once it enters the reservoir. This wasted energy reduces the efficiency of the entire hydraulic system over a course of machine duty cycle. A prime example of energy loss in an excavator is its swing drive where the fluid emptying to the low pressure reservoir is throttled over a valve during the retardation portion of its motion to effect braking of swing motion. It is estimated that total duration of swing use in an excavator is about 50%-70% of an entire life cycle and it consumes 25%-40% of the energy that engine provides. Another undesirable effect of fluid throttling is heating of the hydraulic fluid that results in increased cooling cost.

SUMMARY

At least one embodiment of the invention provides a swing drive system of a vehicle comprising: A swing drive system of a vehicle comprising: a prime mover mechanically connected to a first hydraulic pump/motor; a second hydraulic pump/motor mechanically connected to a swing mechanism; a hydraulic circuit connecting a hydraulic fluid reservoir, a hydraulic accumulator, the first hydraulic pump/motor, and the second hydraulic pump/motor; wherein the system is operable in a first mode where the second hydraulic pump/motor acts as a pump to retard movement of the swing mechanism and pressurized hydraulic fluid from the second hydraulic pump/motor is pumped into the hydraulic accumulator; and wherein the system is operable in a second mode wherein the second hydraulic pump/motor acts as a motor to provide supplementary power to the swing mechanism using pressurized fluid from the hydraulic accumulator.

At least one embodiment of the invention provides a swing drive system of a vehicle comprising: a prime mover mechanically connected to a first hydraulic pump/motor; a second hydraulic pump/motor mechanically connected to a swing mechanism; a hydraulic circuit connecting the first hydraulic pump/motor, the second hydraulic pump/motor, a hydraulic accumulator, and a hydraulic reservoir; an isolation valve associated with the hydraulic accumulator which selectively disconnects the hydraulic accumulator from the rest of the hydraulic circuit; wherein the system is operable in a first mode where the second hydraulic pump/motor acts as a pump to retard movement of the swing mechanism, the pressurized hydraulic fluid from the second hydraulic pump/motor is pumped into the hydraulic accumulator when the isolation valve is open; and wherein the system is operable in a second mode wherein the second hydraulic pump/motor provides a supplementary power to the swing mechanism using pressurized fluid from the hydraulic accumulator when the isolation valve is open; and wherein the system is operable is a third mode where the second hydraulic pump/motor acts as a pump to retard movement of the swing mechanism, the pressurized hydraulic fluid from the second hydraulic pump/motor rotates the first hydraulic pump/motor as a motor which provides supplemental power to the prime mover when the isolation valve is closed.

At least one embodiment of the invention provides a swing drive system of a vehicle comprising: a prime mover mechanically connected to a first hydraulic pump/motor through a mechanical gearset; a second hydraulic pump/motor mechanically connected to a swing mechanism through the mechanical gear set; wherein the mechanical gear set includes a reverse gear; a hydraulic circuit connecting the first hydraulic pump/motor, the second hydraulic pump/motor, a hydraulic accumulator, and a hydraulic reservoir; an isolation valve associated with the hydraulic accumulator which selectively disconnects the hydraulic accumulator from the rest of the hydraulic circuit; wherein the system is operable in a first mode where the second hydraulic pump/motor acts as a pump to retard movement of the swing mechanism, the pressurized hydraulic fluid from the second hydraulic pump/motor is pumped into the hydraulic accumulator when the isolation valve is open; and wherein the system is operable in a second mode wherein the second hydraulic pump/motor provides a supplementary power to the swing mechanism using pressurized fluid from the hydraulic accumulator when the isolation valve is open; and wherein the system is operable is a third mode where the second hydraulic pump/motor acts as a pump to retard movement of the swing mechanism, the pressurized hydraulic fluid from the second hydraulic pump/motor rotates the first hydraulic pump/motor as a motor which provides supplemental power to the prime mover when the isolation valve is closed.

BRIEF DESCRIPTION OF THE DRAWINGS

Embodiments of this invention will now be described in further detail with reference to the accompanying drawings, in which.

DETAILED DESCRIPTION OF THE DRAWING

Figure 1:
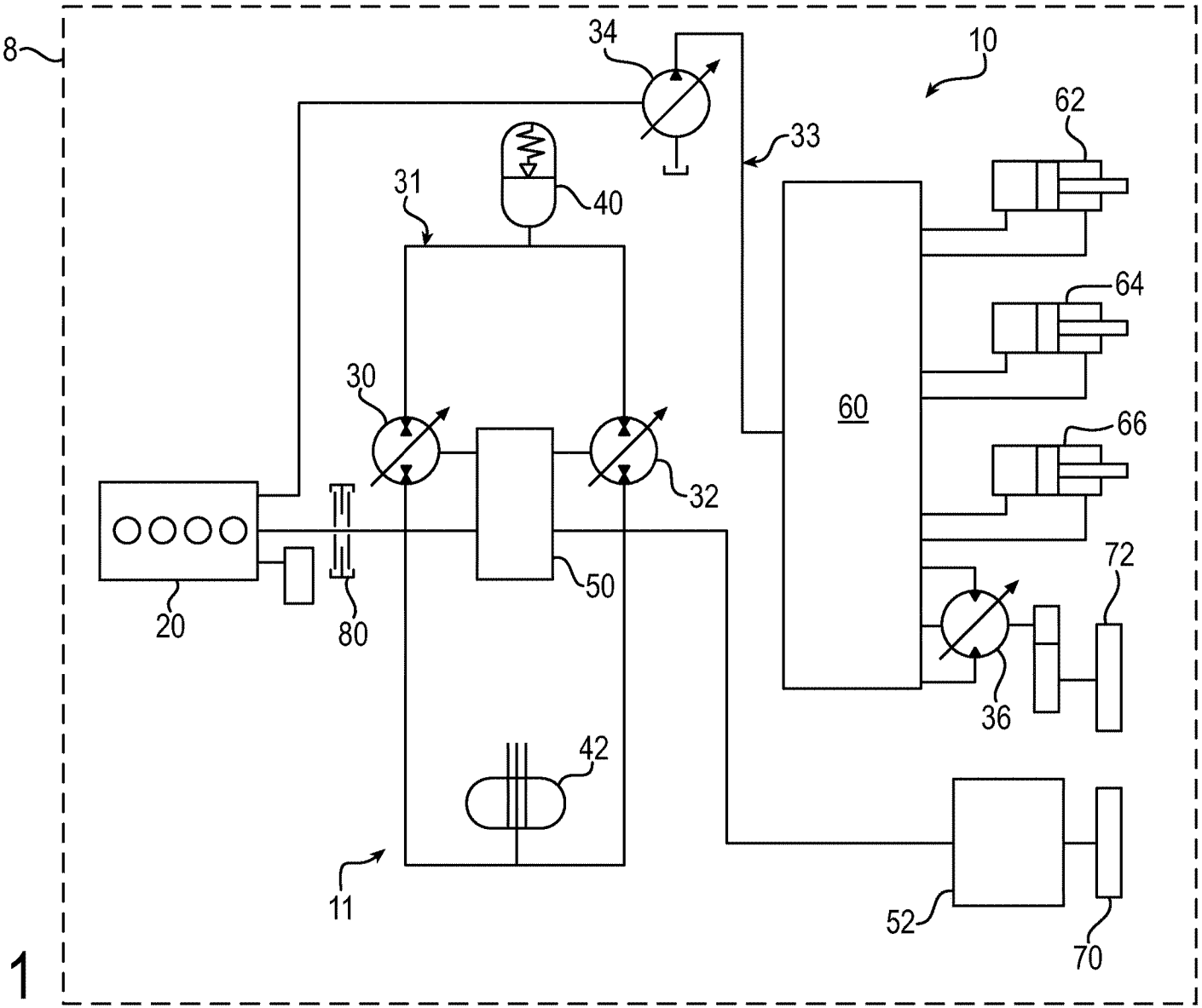
FIG. 1 is a schematic view of a hydraulic hybrid drive system including a swing drive system in accordance with an embodiment of the invention.

Referring to FIG. 1, a hydraulic hybrid drive system 10 including a hydraulic swing drive system 11 can be seen to form a part of an excavator 8. The hydraulic drive system 10 utilized in the excavator 8 involves the upper structure, undercarriage, swing, boom, arm and bucket of the excavator 8. The hydraulic swing drive system 11 comprises a prime mover 20. The prime mover 20 preferably is an internal combustion (IC) engine, but other prime movers could also be used, such as gas turbines, electric motors and fuel cells. The prime mover 20 is mechanically connected to a first hydraulic unit 30 and a second hydraulic unit 32 mechanically connected to a swing mechanism 70. The hydraulic units 30, 32 are preferably of a variable displacement type and reversible and can function either as a pump or motor and are referred to herein as hydraulic units or hydraulic pump/motors. By way of example, the hydraulic units may be axial piston pump/motors, wherein displacement of the pump/motor is varied by changing the tilt angle of a tiltable swash plate, in a manner that is well known to those skilled in the art.

As shown in the embodiment of FIG. 1, the mechanical connection between the prime mover 20 and the first hydraulic unit 30 includes a transmission with a gear set 50 and a shaft connecting the transmission with the gear set 50 to the prime mover 20 and a shaft connecting the transmission with the gear set 50 to the first hydraulic unit 30. The mechanical connection between the swing mechanism 70 and the second hydraulic unit 32 also includes the transmission with the gear set 50 and a shaft connecting the transmission with the gear set 50 to the swing mechanism 70 and a shaft connecting the transmission with the gear set 50 to the second hydraulic unit 32. The mechanical connection also includes a planetary gear set 52 associated with the swing mechanism 70. The transmission gear set 50 can either be a planetary or simple gear type set. The transmission gear set 50 includes a reverse gear to effect the reversal of swing. The reverse gear is engaged during propulsion and braking of swing machinery in the opposite direction to avoid violating the physical limitations of one or both hydraulic units 30, 32. The embodiment optionally includes a clutch 80 positioned to selectively disconnect the mechanical connection between the prime mover 20 and the first hydraulic unit 30.

The swing drive system 11 includes a first hydraulic circuit 31 connecting an energy recovery device 40, shown as an accumulator, and a fluid reservoir 42 with the first hydraulic unit 30 and the second hydraulic unit 32. The hydraulic units 30, 32 are hydraulically coupled to each other and also inter-connected with the accumulator 40 which provides energy storage and also acts as the source of power to drive the hydraulic swing motor in certain conditions.

The hydraulic hybrid drive system 10 includes the prime mover 20 that is also mechanically connected to a hydraulic pump 24. Hydraulic pump 34 is hydraulically connected through a second hydraulic circuit 33 to control valves 60 and to a plurality of hydraulic power consumers including a boom cylinder 62, arm cylinder 64, bucket cylinder 66, and travelling motor 36 which is mechanically connected to reduction unit 72.

Figure 2:
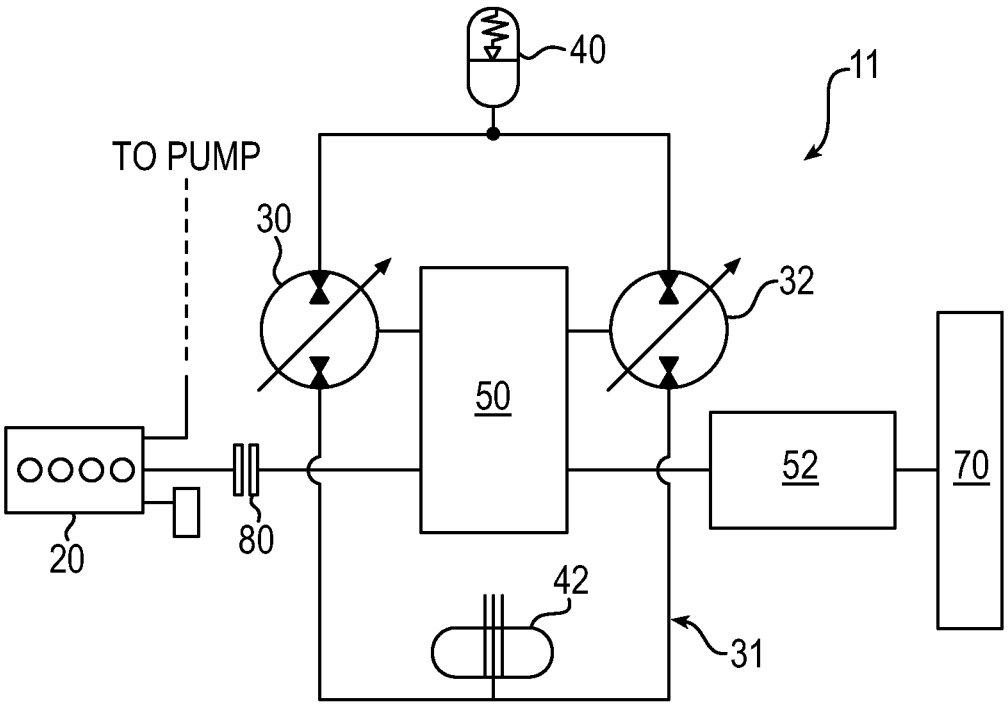
FIG. 2 is a schematic view of swing drive system portion of the hydraulic hybrid drive system shown in FIG. 1.

Referring now to FIG. 2, the swing drive system 11 portion of the hybrid hydraulic drive system 10. FIG. 2 is the same as the hydraulic drive system 10 of FIG. 1 except that the elements associated with the second hydraulic circuit 33 have been removed for clarity. A dash line designated "To Pump" represents the removed portion of the hybrid hydraulic drive system 10.

Figure 3:
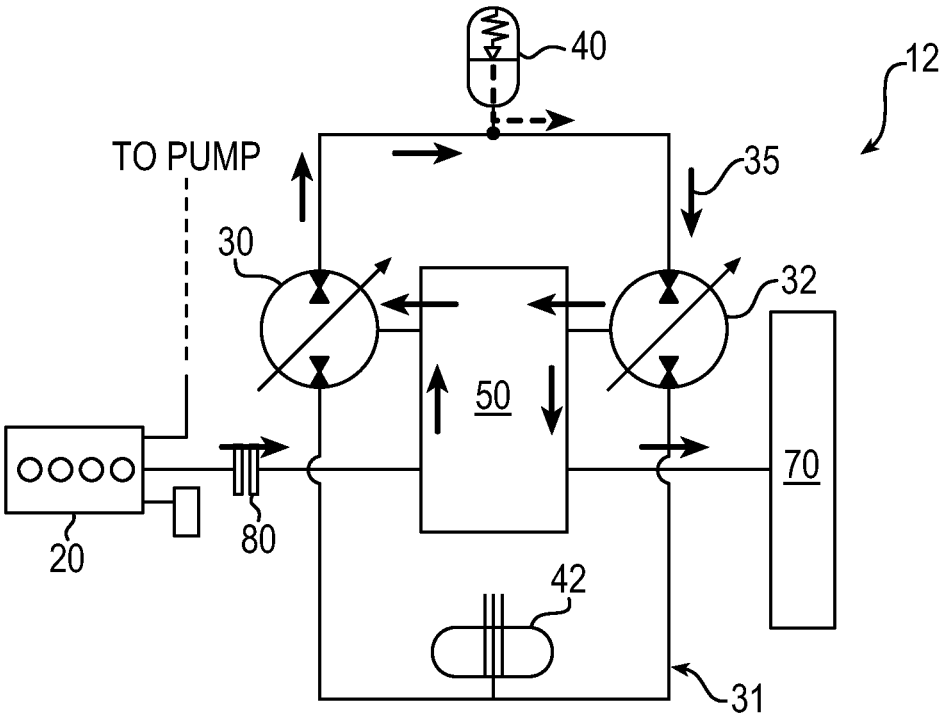
FIG. 3 is a schematic view of another embodiment of a swing drive system showing the prime mover and the accumulator driving the swing mechanism.

Referring to FIG. 3, the swing drive system 12 is the same as the swing drive system 11 of FIG. 2 except that swing drive system 12 does not have a planetary gear system 52 between the swing mechanism 70 and the transmission gear 50. In FIG. 2, the second hydraulic unit 32 is a low speed, high torque unit that obviated the need for a planetary gear set 52. With certain second hydraulic units, it may be necessary to use a single or multiple stage planetary gear reduction to achieve the desired torque and speed ratio between second hydraulic unit output and the swing mechanism.

During propulsion of the swing mechanism 70 to one side in normal operation, the prime mover 20 drives the first hydraulic unit 30 through the transmission gear 50. The first hydraulic unit 30 acts as a pump and supplies the pressurized fluid to secondary hydraulic unit 32 which turns as a motor and propels the swing machinery 70 through the transmission gear 50. FIG. 3 shows the direction of power flow during the propulsion phase with arrows 35. Depending on the amount of energy stored in the accumulator 40, there is a possibility of power blending to assist the prime mover 20 as shown by a dotted arrow. With the possible layouts of transmission gear set 50 either as a planetary or simple gear set, the second hydraulic unit output can either be combined with part of the engine power or can drive the swing mechanism 70 alone. It is also possible to establish a direct mechanical connection between prime mover 20 and swing mechanism 70 through the gear set 50 and hence bypass the hydraulic units 30, 32 for a more efficient operation during propulsion.

To apply braking to retard the motion of the swing mechanism 70 and possibly bring it to a stop, the displacement of second hydraulic unit 32 is controlled to go "over-center", thereby reversing the direction of applied torque.

Figure 4:
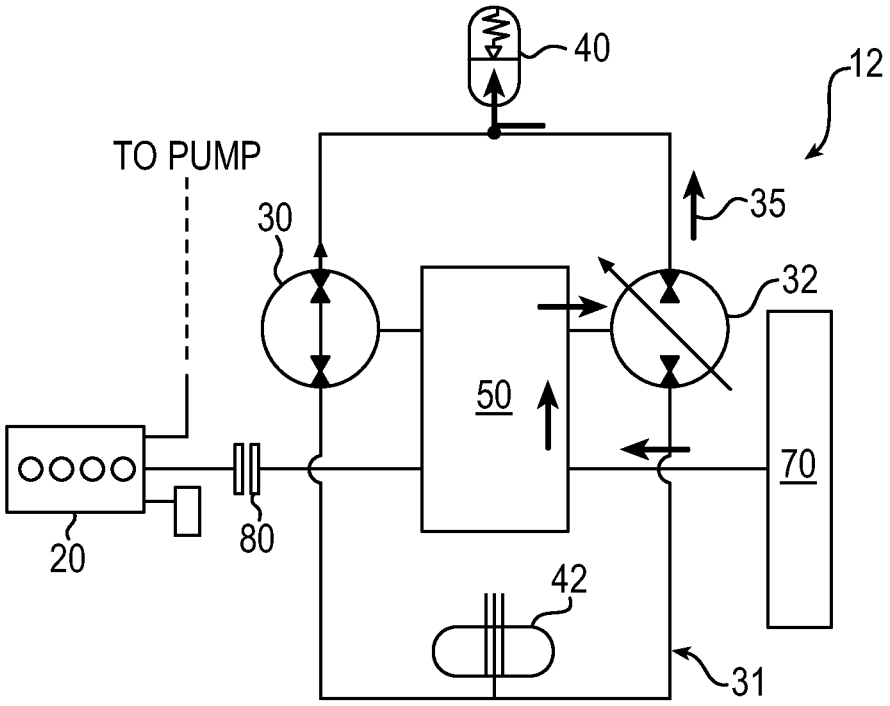
FIG. 4 is a schematic view of the swing drive system of FIG. 3 showing the swing energy being stored in the accumulator.

During a swing braking event, the swing mechanism 70 supplies torque through the transmission gear 50 to the second hydraulic unit 32. The second hydraulic unit 32 acts as a pump and supplies power back into hydraulic circuit 31 to be stored in the accumulator 40, as shown by the arrows 35 in FIG. 4. This represents an energy recovery mode of operation of the embodiment. The second hydraulic unit 32 applies a resistive torque enabling the capture of the kinetic energy of swing machinery 70. Also notice in FIG. 4 that the first hydraulic unit 30 is controlled to be at its minimum displacement and that the accumulator 40 is receiving captured braking energy for storage while swing is slowing down.

It is also possible to utilize this embodiment of the swing drive system 12 in a power boost operational mode. With a power-split embodiment of transmission gear set 50 a power-boost feature is available during peak swing torque requirement. The one-way clutch 80 can be locked up and accumulator 40 can provide a torque boost through the first hydraulic unit 30 acting as a motor that supplements the torque output of the second hydraulic unit 32. The result is a torque at the output of gear set 50 that is more than what is normally available.

Figure 5:
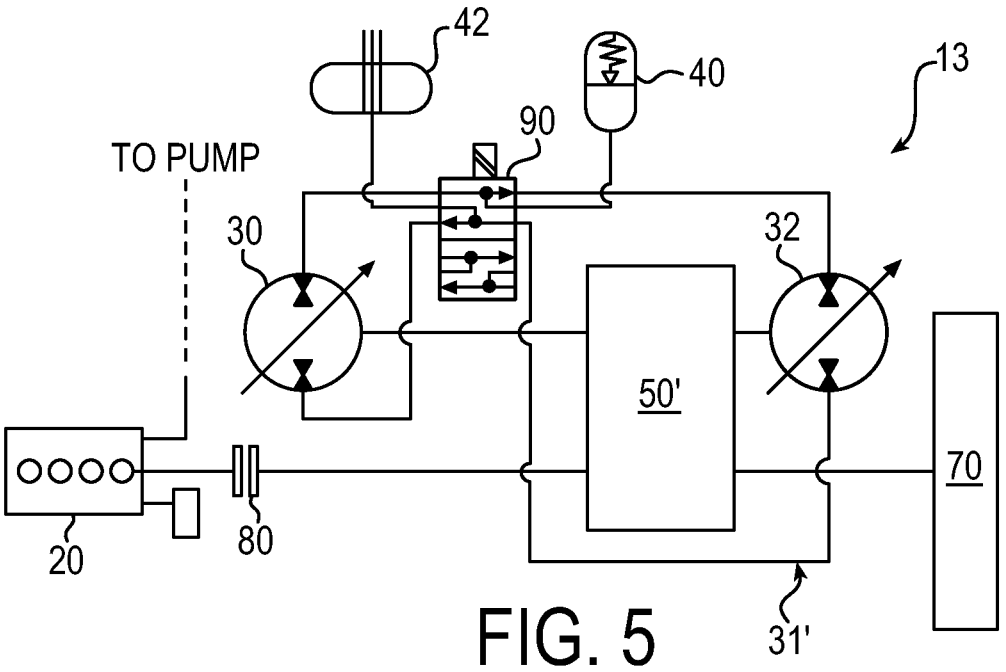
FIG. 5 is a schematic view of another embodiment of a swing drive system similar to FIG. 3 but including a directional valve.

Referring to FIG. 5, another embodiment of the swing drive system is designated at 13. The swing drive system 13 is similar to the swing drive system 12 of FIGS. 2-4, except that the transmission gear set 50' does not include a reverse gear, requiring that swing drive 13 includes a directional valve 90. Directional valve 90 connects the accumulator 40 and reservoir 42 to high and low pressure lines respectively during swing operation in both directions.

Figure 6:
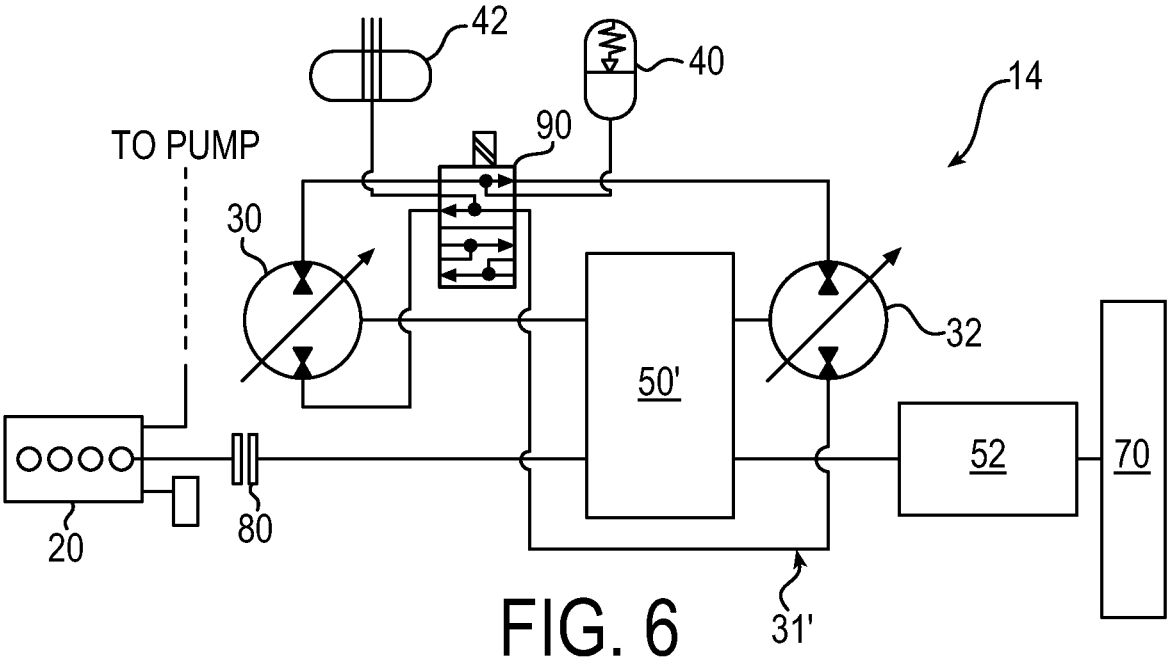
FIG. 6 is a schematic view of another embodiment of a swing drive system similar to FIG. 5 but including a planetary gear set.

Referring to FIG. 6, another embodiment of the swing drive system is designated at 14. The swing drive system 14 is similar to the swing drive system 13 of FIG. 5, except for the addition of a planetary gear set 52 positioned between the swing mechanism 70 and the transmission gear set 50'. Depending on the particular arrangement of transmission gear set 50', it is possible to meet the desired speed ratio at the swing mechanism 70 by either a high torque, low speed second hydraulic unit 32, if available, or a gear ratio internal to transmission gear set 50'. If neither is available, a separate planetary gear reduction 52 may be necessary, as shown in FIG. 6.

Figure 7:
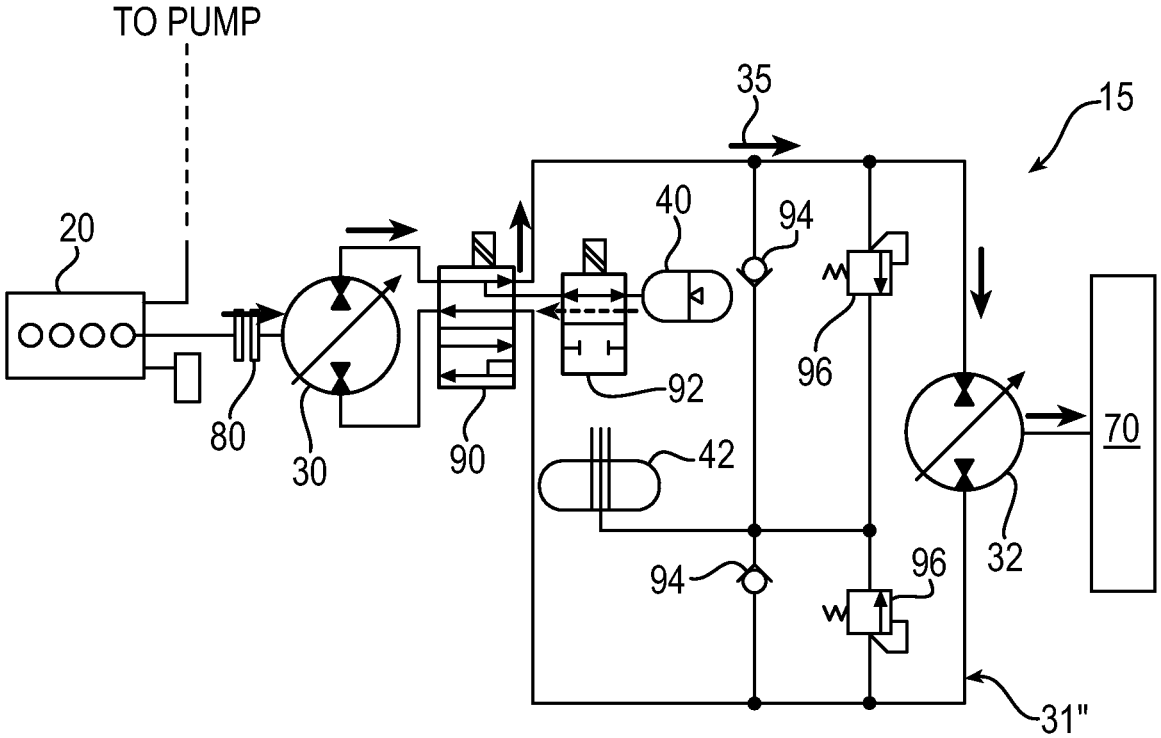
FIG. 7 is a schematic view of another embodiment of a swing drive system shown wherein the system is a hydrostatic drive showing the prime mover and the accumulator driving the swing mechanism.

Referring now to FIG. 7, an embodiment is shown in a hydrostatic configuration. The swing drive system 15 comprises a prime mover 20 mechanically connected to a first hydraulic unit 30 and a second hydraulic unit 32 mechanically connected to a swing mechanism 70. The system 15 includes a hydraulic circuit 31" connecting an energy storage device 40, shown as an accumulator, and a fluid reservoir 42 with the first hydraulic unit 30 and the second hydraulic unit 32. The first hydraulic unit 30 and the second hydraulic unit 32 are reversible and can function as either a pump or a motor. The accumulator 40 may be connected to the either fluid line with the help of a directional valve 90, which in turn is controlled by an electric current or a hydraulic pilot signal (not shown). Based on the availability of a low speed, high torque drive motor, it is also possible to directly connect the secondary hydraulic unit 32 to the swing machinery 70 without a planetary gear reduction unit. An isolation valve 92 serves the purpose of connecting or disconnecting the accumulator 40 to hydraulic circuit 31" anytime during operation.

During propulsion of the swing drive to one side in normal operation, the prime mover 20 drives the first hydraulic unit 30 which acts as a pump and supplies the pressurized fluid to secondary hydraulic unit 32 which turns as a motor and propels the swing machinery 70. FIG. 7 shows the direction of power flow during the propulsion phase with arrows 35. In one mode of operation of the energy recovery aspect of the embodiment, the accumulator 40 may be connected to the high pressure line through the isolation valve 92 to assist the prime mover 20 if there is energy stored in it. The motion of the swing drive can be controlled by a controller controlling the displacement of the hydraulic units 30, 32.

Figure 8:
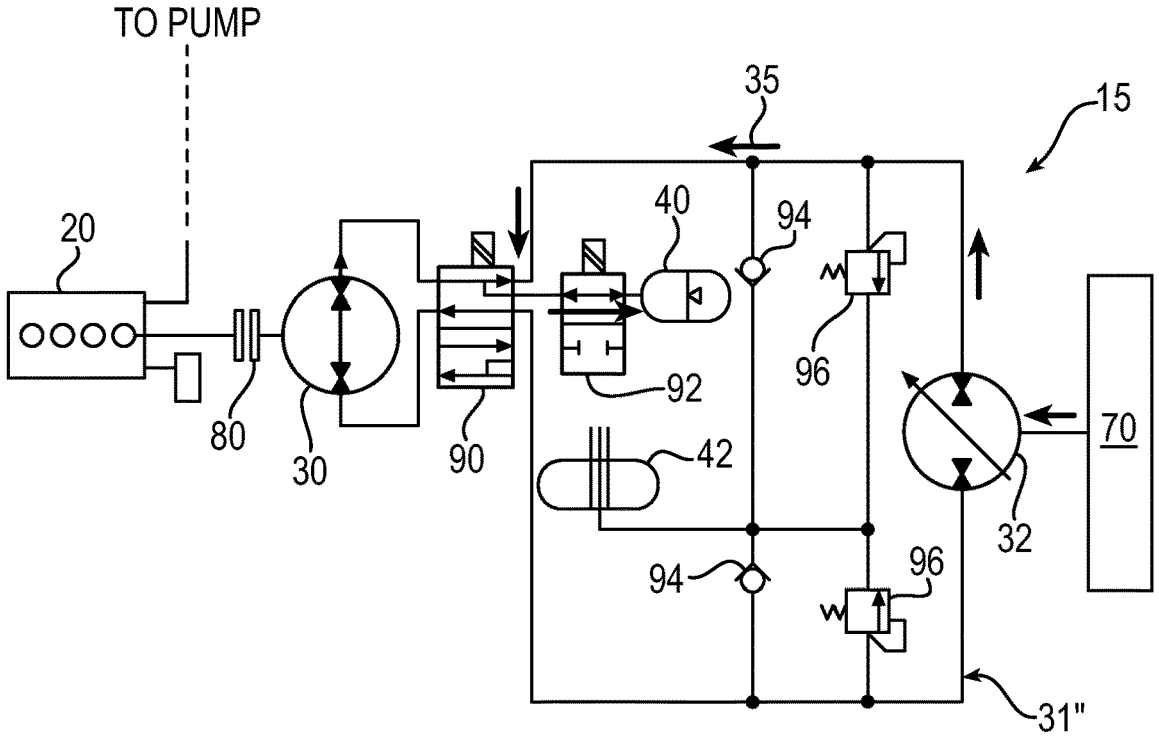
FIG. 8 is a schematic view of the swing drive system of FIG. 7 showing the swing energy being stored in the accumulator.

To apply braking to retard the motion of the swing mechanism 70 and possibly bring it to a stop, the displacement of second hydraulic unit 32 is controlled to go overcenter, thereby reversing the direction of applied torque. During a swing braking event, the second hydraulic unit 32 acts as a pump and supplies power back into hydraulic circuit 31", as shown by the arrows 35 in FIG. 8. The second hydraulic unit 32 pumps hydraulic fluid through the directional valve 90 and the isolation valve 92 to be stored in the accumulator 40 representing another mode of operation of the energy recovery aspect of the embodiment. The second hydraulic unit 32 applies a resistive torque and enabling the capture of the kinetic energy of swing machinery 70. Also notice in FIG. 8 that the first hydraulic unit 30 is controlled to be at its minimum displacement and that the accumulator 40 is receiving captured braking energy for storage while swing mechanism 70 is slowing down.

Figure 9:
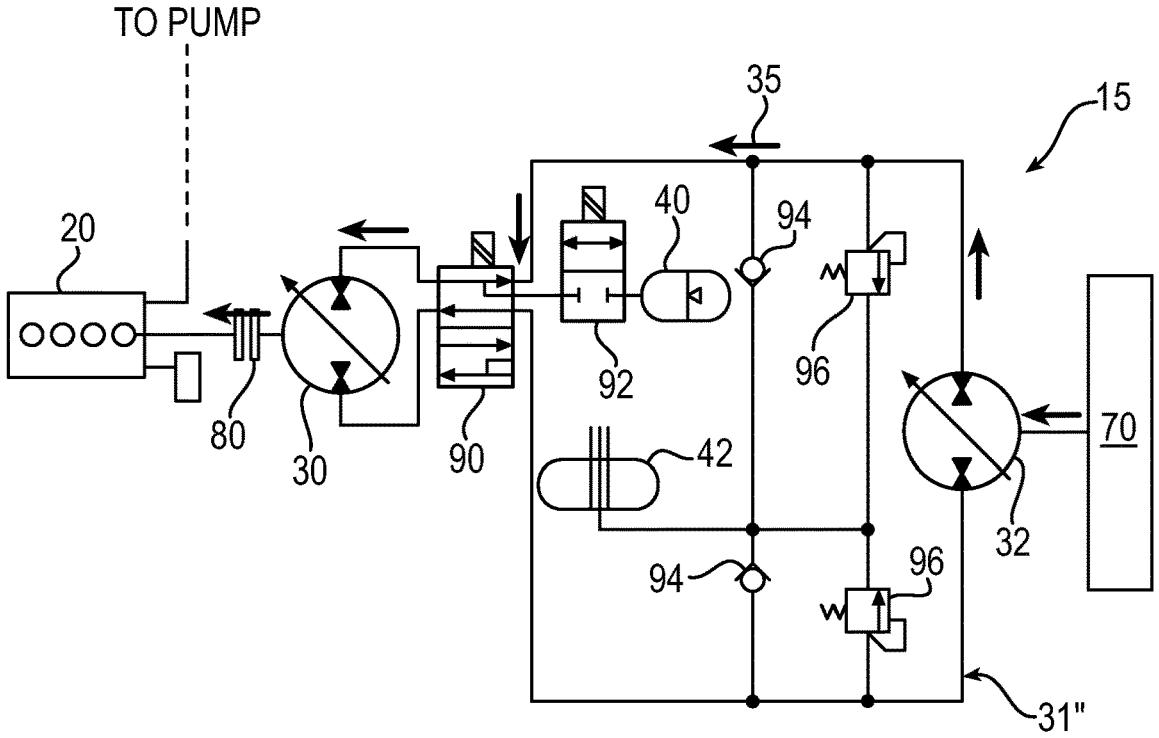
FIG. 9 is a schematic view of the swing drive system of FIG. 7 showing the swing energy being used to assist the prime mover.

It may be decided, based on machine operation, to put the recovered energy back on the engine shaft for immediate use or for powering a simultaneous work function or an accessory. The accumulator can be disconnected or connected to the hydraulic circuit 31". Referring to FIG. 9, a scenario is depicted in which the accumulator is disconnected from the hydraulic circuit 31" during braking by energizing the isolation valve 92. In this case, the first hydraulic unit 30 acts as a motor while its displacement is controlled to go overcenter. As represented by the arrows 35, the recovered energy is delivered to the prime mover 20 through the engine shaft in the form of assisting torque for immediate consumption. This scenario represents a third mode of operation of the energy recovery aspect of this embodiment.

For propelling the swing in the opposite direction, the first hydraulic unit 30 is controlled to go overcenter while acting as a pump driven by the prime mover 20. It reverses the direction of flow in the hydraulic circuit 31". The pressurized fluid turns the second hydraulic unit 32 acting as a motor in a direction opposite of the previous instance, which in turn moves the swing mechanism 70 to achieve the desired motion. Note that high and low pressure fluid lines are switched with the reversal of flow direction in the circuit 31". The directional valve 90 helps connect the accumulator 40 and reservoir 42 to high and low pressure lines respectively in all scenarios. During the event of braking, hydraulic circuit operation with or without an accumulator 40 is similar to the previous case.

Figure 10:
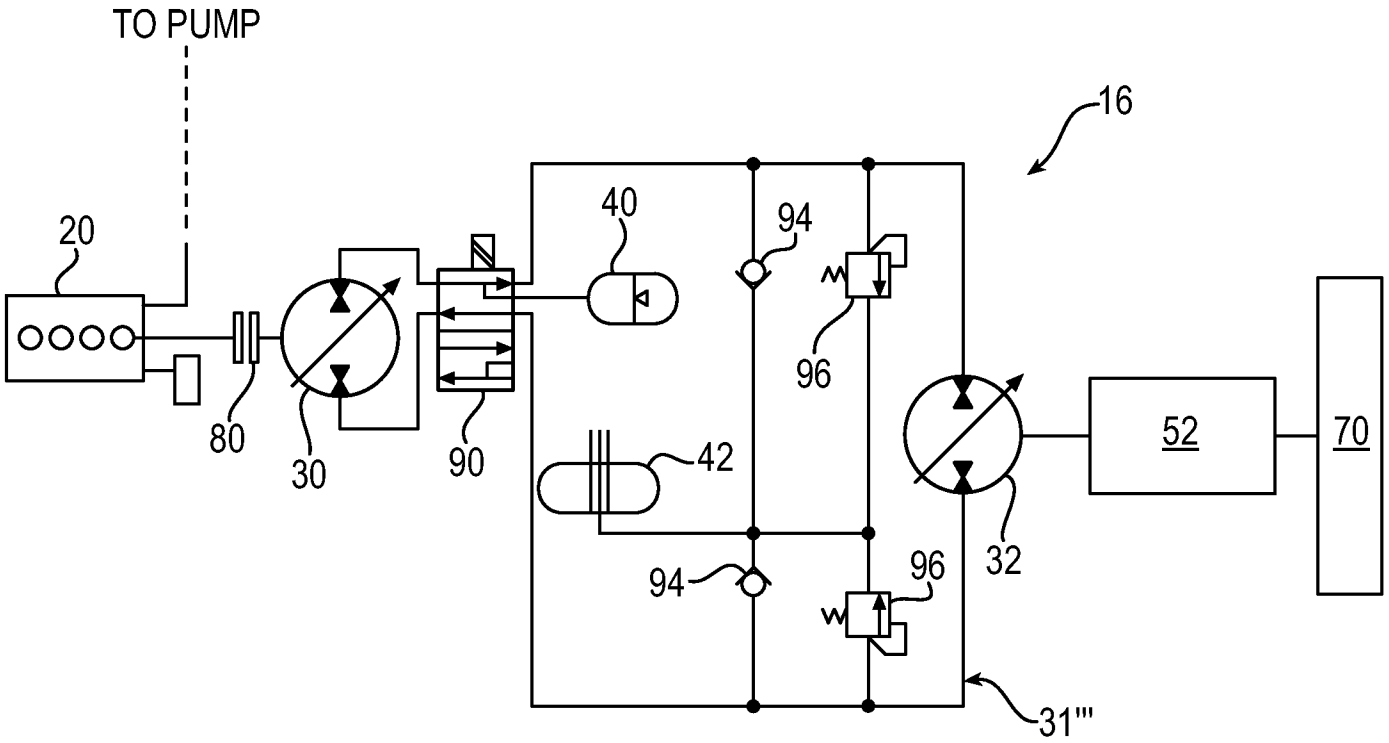
FIG. 10 is a schematic view of another embodiment of a swing drive system similar to FIG. 7 but including a planetary gear set.

Referring to FIG. 10, another embodiment of the swing drive system is designated at 16. The swing drive system 16 is similar to the swing drive system 15 of FIGS. 7-9, except for the addition of a planetary gear set 52 positioned between the swing mechanism 70 and the second hydraulic unit. While it is possible to meet the desired speed ratio at the swing mechanism 70 by utilizing a high torque, low speed second hydraulic unit 32, if one is not available, a separate planetary gear reduction 52 may be necessary, as shown in FIG. 10.

Figure 11:
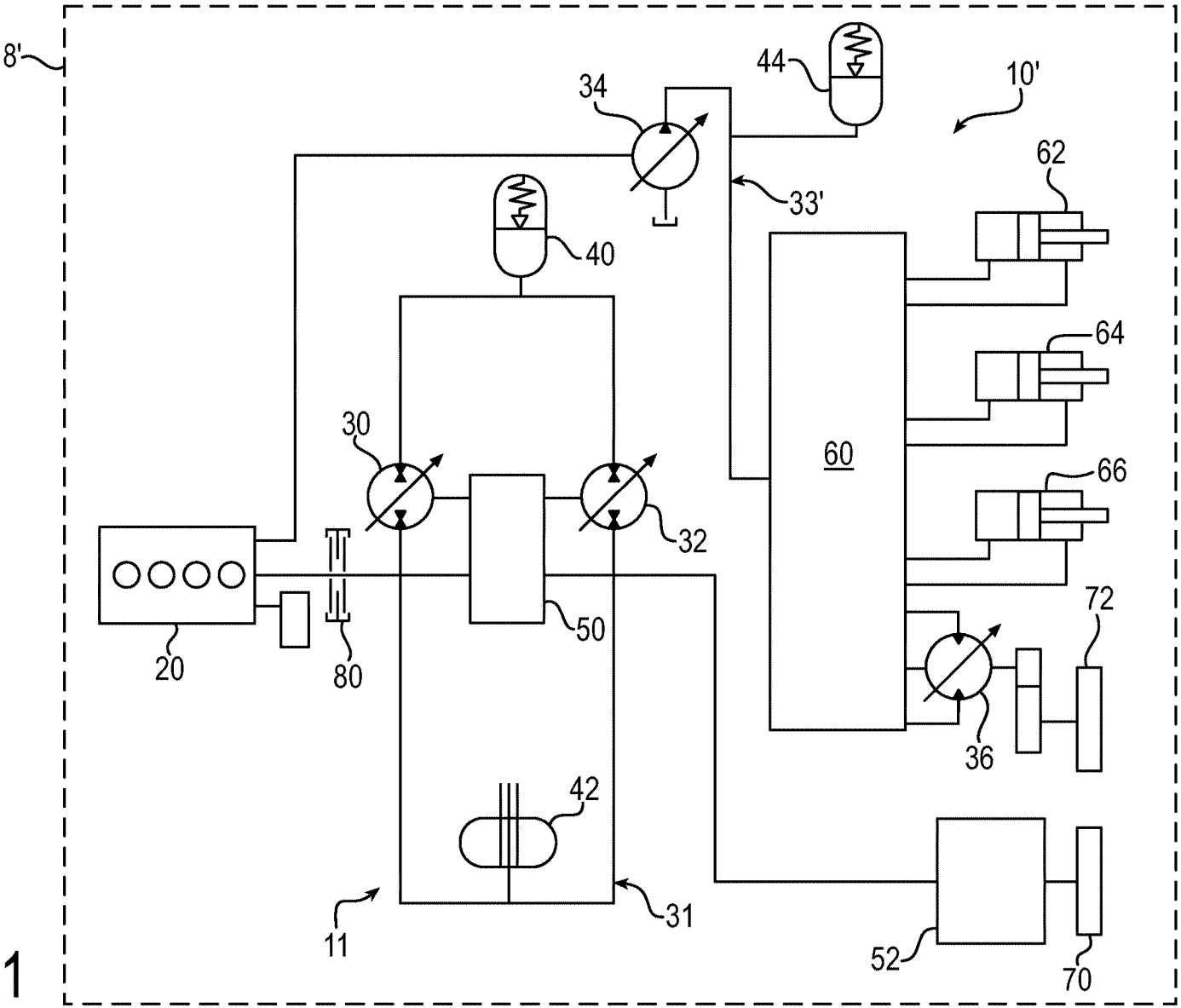
FIG. 11 is a schematic view of a hydraulic hybrid drive system similar to FIG. 1 but including an accumulator associated with a pump for the non-swing hydraulic consumers.

Referring to FIG. 11, an embodiment of the hydraulic system 10' is shown which is similar to the hydraulic system 10 of FIG. 1, except that the hydraulic drive system 10' comprises a mechanical connection of the swing mechanism and the second hydraulic unit 32 which is not directed through the transmission gear set.

Figure 12:
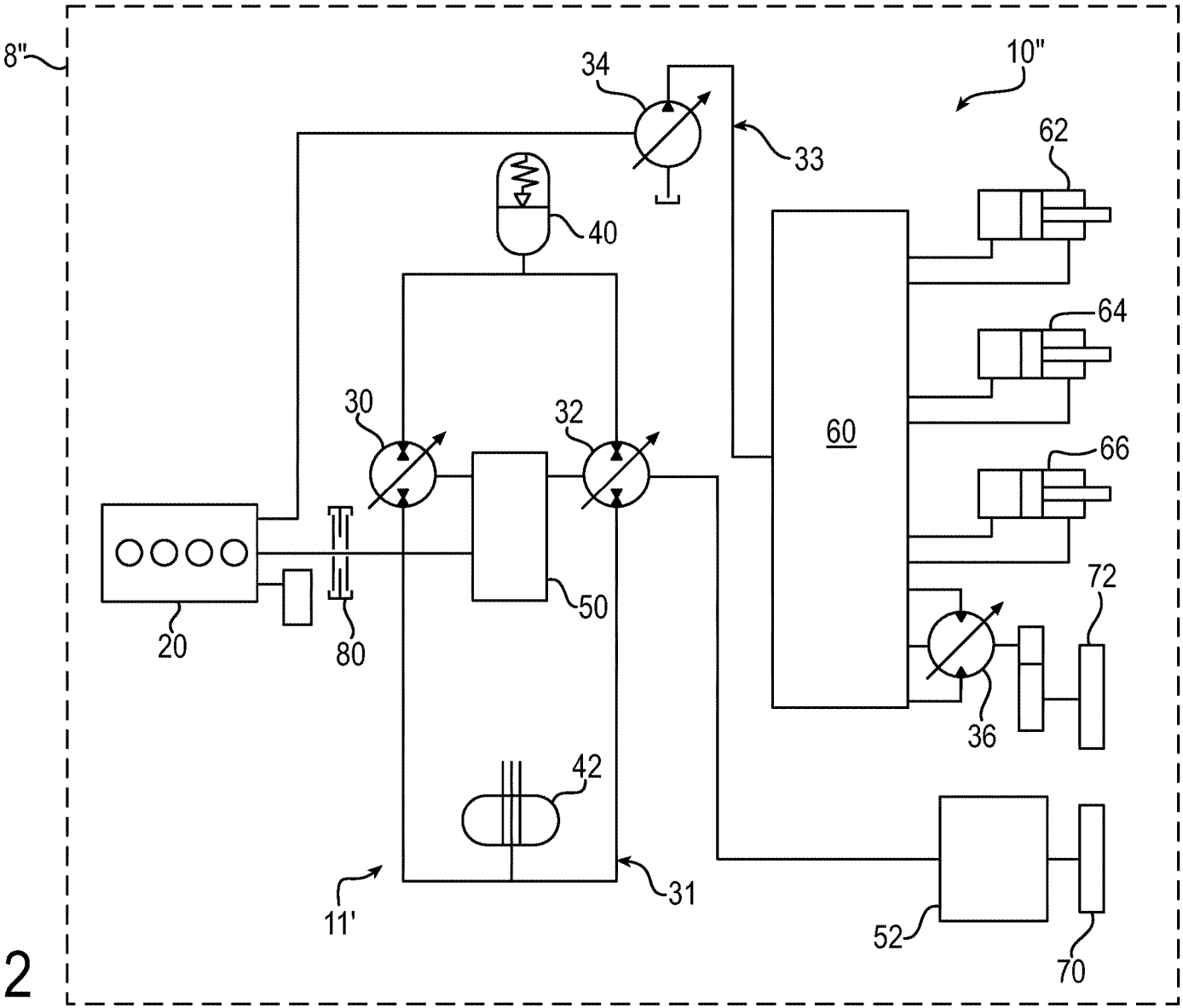
FIG. 12 is a schematic view of a hydraulic hybrid drive system similar to the system of FIG. 1 except that the second hydraulic unit is mechanically connected to the swing mechanism without intermediately passing through the gear set.

Referring to FIG. 12, an embodiment of the hydraulic system 10" is shown which is similar to the hydraulic system 10 of FIG. 1, except that an additional accumulator 44 is provided on the supply side of the pump 34 which integrates the operation of the accumulator 44 with the boom cylinder 62, arm cylinder 64, and bucket cylinder 66 actuation. The accumulator 44 provides a boost capacity to increase the response time of the function as the pump 34 is coming up to stroke/pressure to meet system demands.

Although the principles, embodiments and operation of the present invention have been described in detail herein, this is not to be construed as being limited to the particular illustrative forms disclosed. For example, although isolation valve 92 is not shown in some embodiments, it should be obvious that it could be present in any arrangement where isolating the accumulator is desired. They will thus become apparent to those skilled in the art that various modifications of the embodiments herein can be made without departing from the spirit or scope of the invention.

The invention claimed is:

1. An excavator comprising:

a prime mover;

an excavator swing mechanism configured to rotate an upper structure of the excavator relative to an undercarriage of the excavator;

a first hydraulic pump/motor mechanically connected to the prime mover;

a second hydraulic pump/motor mechanically connected to the excavator swing mechanism;

a hydraulic fluid reservoir;

a hydraulic accumulator;

a hydraulic circuit connecting the hydraulic fluid reservoir, the hydraulic accumulator, the first hydraulic pump/motor, and the second hydraulic pump/motor;

wherein, in a first mode, the second hydraulic pump/motor acts as a pump to retard movement of the excavator swing mechanism and pressurized hydraulic fluid from the second hydraulic pump/motor is pumped into the hydraulic accumulator; and wherein, in a second mode, the second hydraulic pump/motor acts as a motor to provide power to the excavator swing mechanism using pressurized fluid from the hydraulic accumulator.

2. The excavator according to claim 1, further comprising a directional valve positioned within the hydraulic circuit selectively reversing the flow of fluid through the hydraulic circuit and providing a fluid path to the hydraulic accumulator.

3. The excavator according to claim 2, further comprising an isolation valve associated with the hydraulic accumulator which selectively disconnects the hydraulic accumulator from the rest of the hydraulic circuit.

4. The excavator according to claim 1, wherein the system is operable in a third mode where the second hydraulic pump/motor acts as a pump to retard movement of the excavator swing mechanism and pressurized hydraulic fluid from the second hydraulic pump/motor is directed to the first hydraulic pump/motor which acts as a motor to provide assisting torque to the prime mover.

5. The excavator according to claim 1, wherein the mechanical connection of the second hydraulic pump/motor to the excavator swing mechanism includes a planetary gear set.

6. The excavator according to claim 1, wherein the hydraulic circuit is a hydrostatic transmission.

7. The excavator according to claim 1, further comprising a clutch positioned to selectively disconnect the mechanical connection between the prime mover and the first hydraulic pump/motor.

8. The excavator according to claim 1, wherein the prime mover is also mechanically connected to a hydraulic pump which is hydraulically connected to a plurality of hydraulic power consumers.

9. An excavator of a vehicle comprising:

an excavator swing mechanism configured to rotate an upper structure of the excavator relative to an undercarriage of the excavator;

a prime mover mechanically connected to a first hydraulic pump/motor;

a second hydraulic pump/motor mechanically connected to the excavator swing mechanism;

a hydraulic circuit connecting the first hydraulic pump/motor, the second hydraulic pump/motor, a hydraulic accumulator, and a hydraulic reservoir;

an isolation valve associated with the hydraulic accumulator which selectively disconnects the hydraulic accumulator from the rest of the hydraulic circuit;

wherein the system is operable in a first mode where the second hydraulic pump/motor acts as a pump to retard movement of the excavator swing mechanism, the pressurized hydraulic fluid from the second hydraulic pump/motor is pumped into the hydraulic accumulator when the isolation valve is open; and wherein the system is operable in a second mode wherein the second hydraulic pump/motor provides a supplementary power to the swing mechanism using pressurized fluid from the hydraulic accumulator when the isolation valve is open; and wherein the system is operable is a third mode where the second hydraulic pump/motor acts as a pump to retard movement of the excavator swing mechanism, the pressurized hydraulic fluid from the second hydraulic pump/motor rotates the first hydraulic pump/motor as a motor which provides supplemental power to the prime mover when the isolation valve is closed.

10. The excavator according to claim 9, further comprising a directional valve positioned within the hydraulic circuit selectively reversing the flow of fluid through the hydraulic circuit and providing a fluid path to the hydraulic accumulator.

11. The excavator according to claim 9, further comprising a planetary gear set positioned between the second pump/motor and the excavator swing mechanism.

12. The excavator according to claim 9, wherein the hydraulic circuit is a hydrostatic transmission.

* * * * *